United States Patent [19]

Hawkins et al.

[11] Patent Number: 4,549,464

[45] Date of Patent: Oct. 29, 1985

[54] INFLATABLE, AERODYNAMIC SHROUD

[75] Inventors: David K. Hawkins, Brigham City; Donald R. Sauvageau, North Ogden, both of Utah

[73] Assignee: Morton Thiokol, Inc., Chicago, Ill.

[21] Appl. No.: 582,972

[22] Filed: Feb. 23, 1984

[51] Int. Cl.[4] ..... F41F 3/04

[52] U.S. Cl. ..... 89/1.809; 89/1.14; 89/1.810; 244/160; 244/219

[58] Field of Search ..... 89/1 B, 1.810, 1.819, 89/1.817; 244/219 A, 160; 114/67 R

[56] References Cited

U.S. PATENT DOCUMENTS

| | | | |
|---|---|---|---|
| 3,404,598 | 10/1968 | Angelos | 89/1 B |
| 3,948,143 | 4/1976 | Olsen | 89/1 B |
| 3,970,006 | 7/1976 | Copeland et al. | 89/1.817 X |
| 4,166,597 | 9/1979 | Seifert et al. | 244/160 |
| 4,166,598 | 9/1979 | Seifert et al. | 244/160 |
| 4,304,186 | 12/1981 | Fischer et al. | 102/401 |

OTHER PUBLICATIONS

"Inflatable Space Station Escape Vehicle Under Study", in Aviation Week & Space Technology, pp. 62, 63, 64 & 69, May 6, 1963.

*Primary Examiner*—David H. Brown
*Attorney, Agent, or Firm*—Gerald K. White

[57] ABSTRACT

An inflatable shroud allows a propulsion system that is stored in fixed length and diameter cylinders or silos to occupy all of the available packaging length. When inflated the shroud provides the desired aerodynamic shape to reduce drag and improve performance. The inflatable shroud may be used on any aerodynamic structure that would benefit from an improved aerodynamic shape.

12 Claims, 2 Drawing Figures

INFLATABLE, AERODYNAMIC SHROUD

The U.S. Government has rights in this invention pursuant to Contract No. N0003082C0099 awarded by the U.S. Navy Department.

BACKGROUND OF THE INVENTION

1. Field of Invention

This invention relates to an improvement in aerodynamic structures. More particularly, the invention relates to an inflatable shroud that may be used as an aerodynamic structure to improve the aerodynamic characteristics of the forward section or nose cone thereof. The invention is especially applicable to length constrained propulsion systems.

2. Description of the Prior Art

Some propulsion systems, such as those launched from submarines, must be highly packageable, have low weight and provide high performance. Such systems are packaged or stored in fixed length and diameter cylinders or silos. To maximize performance within the available cylinder or silo volume, the majority of this volume is occupied with propulsion components. An aerospike is packaged within the third stage motor and is deployed after launch to reduce drag and improve aerodynamic performance. The aerospike takes up a great deal of the available storage space and adds undesirably to the weight of the system.

SUMMARY OF THE INVENTION

An object of the invention is to provide apparatus including an inflatable shroud that will allow a propulsion system to occupy substantially all of the available packaging or storage space with the shroud, when inflated, providing the desired aerodynamic shape for reducing drag and improving performance.

In accordance with the invention, this is accomplished by folding the shroud, either ductile metal or suitably coated fabric, flush against the forward end of the propulsion system, and inflating the shroud to the desired shape by means of a gas generator system once the propulsion system is deployed into the operational mode thereof. The shape of the inflated shroud is selected to minimize the drag of the propulsion system to the maximum extent possible. The skin of the shroud is air tight, flexible enough to be collapsed and folded around the forward end or nose cone of the propulsion system, and has material properties capable of withstanding the aerodynamic heating and the heat produced by the gas generator. Internal structure, such as cords or straps, may be provided, as necessary, to obtain the rigidity necessary for the shroud to maintain the desired shape thereof during the operational mode of the propulsion system.

BRIEF DESCRIPTION OF THE DRAWINGS

Having summarized the invention, a detailed description follows with reference being made to the accompanying drawings which form part of the specification, of which.

DESCRIPTION OF THE PREFERRED EMBODIMENT

Figure 1:
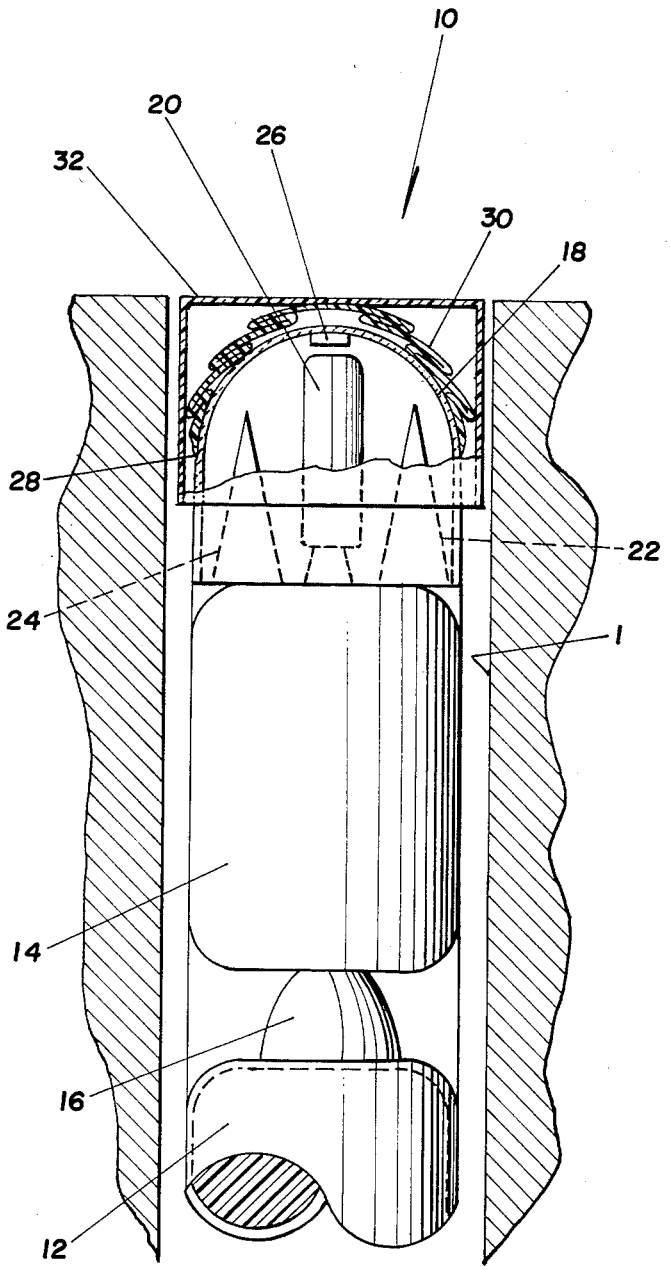
FIG. 1 is a fragmentary schematic illustration, partly in cross section, showing a multiple stage submarine launched propulsion system stored in a fixed length and diameter cylinder, with an inflatable shroud, according to the invention, folded in stowed position flush against the nose cone of the system.

There is illustrated in the fragmentary view of FIG. 1 the forward portion of a submarine launched aerodynamic structure or propulsion system 10 that is stored in a fixed length and diameter cylinder 1 that is appropriately positioned in the submarine. The propulsion system 10 includes a boost propulsion stage 12 and associated exhaust nozzle (not shown), a main propulsion stage 14 and associated nozzle 16, and a nose cone 18. Contained within the nose cone 18 is an upper propulsion stage 20, payload elements 22 and 24, and a solid propellant gas generator 26. The nose cone 18, as illustrated, is blunt, being rounded and shortened, and just long enough to accommodate the upper stage 20, the payload elements 22 and 24, and the gas generator 26. A nose cone 18 having such shape has poor aerodynamic characteristics.

The gas generator 26 may be a conventional solid propellant generator similar to those used for inflating automobile gas bags, and disclosed, for example, in U.S. Pat. No. 4,296,084 to G. V. Adams and F. E. Schneiter.

Figure 2:
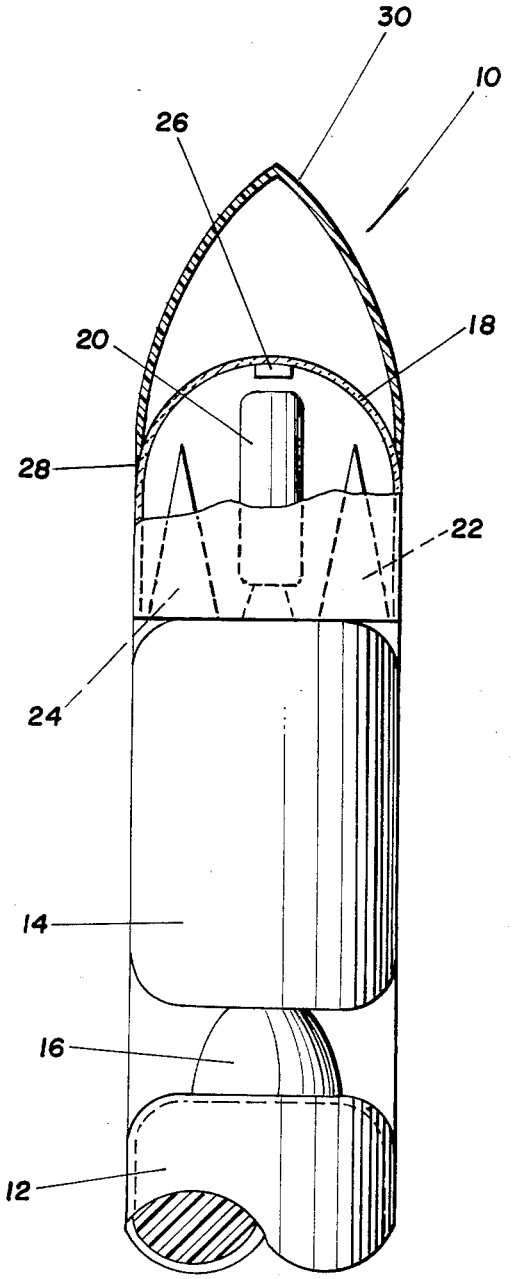
FIG. 2 is a fragmentary schematic illustration partly in cross section showing the propulsion system as having been launched from the storage cylinder and in the operational mode thereof, and with the inflatable shroud in the deployed position thereof.

Attached to the nose cone 18 in an air tight sealed manner, at or near the base thereof, indicated as attach point 28, is an inflatable shroud 30. A protective shipping plastic cover 32 for shroud 30 desirably may be provided. Shroud 30, in stowed position, as shown in FIG. 1, is folded flush against the forward surface of the nose cone 18. Once the propulsion system is placed in operation, the gas generator 26 is, activated by means, not shown, to produce a rapid generation of gas that flows into the shroud 30 for deploying the latter to the inflated shape thereof, as illustrated in FIG. 2. To that end the outlet of the gas generator 26 is suitably connected to the interior space between nose cone 18 and shroud 30. The gas generator 26 may be suitably mounted to the interior forward surface of the nose cone 18, as shown.

The shape of the shroud 30, when inflated, is selected to minimize the drag of the propulsion system as much as possible. The material of the skin of the shroud 30 may be ductile metal or coated fabric or mesh, but it should be air tight, be flexible enough to be collapsed and folded flush against the nose cone 18, have sufficient strength to withstand the dynamic pressures of flight, and have material properties capable of withstanding the aerodynamic heating and the heat produced by the gas generator.

A metallic coating deposited on a plastic sheet such as aluminum coated Mylar is an example of a ductile metal that may be employed as the skin of the shroud 30, the metal preferably forming the outer surface thereof. Mylar is a trademark of E. I. duPont de Nemours & Co. of Wilmington, Del. An example of coated fabric that may be employed for the shroud 30 is neoprene coated rib stock nylon sheet, the seams of which are sewed and sealed with silicone rubbers, similar to the material of inflatable bags used for conventional automobile gas bags.

Pressure levels necessary to withstand the dynamic pressures of flight, approximately 25 to 35 psia for typical ballistic missile trajectories is well within the capabilities of the material used in inflatable gas bag type systems. Additional pressure or internal structure, cords or straps may be provided, if desired, to obtain the rigidity necessary for the shroud 30 to maintain the selected and desired shape during the operational mode of the rocket.

A specific application for the inflatable shroud 30 according to the invention is to replace the aerospike currently being used on certain submarine-launched propulsion systems which are stored in the submarine in approximately positioned fixed length and diameter cylinders. In such application, the aerodynamic shape of the shroud 30 is selected to provide the same or less drag than the aerospike that is being replaced. An advantage of the inflatable shroud is the ability thereof to provide the same or better aerodynamic performance with less added inert weight while occupying substantially less space, that is, shorter length when in the stowed position. Since the shroud 30 can be stowed flush against the nose cone, the only volume required inside the nose cone is a small space to accommodate the gas generator 26 that is needed to inflate the shroud 30. The current system employed for separating the nose cone from the forward portion 10 of the propulsion system may also be used in this application of the invention. Since the gas generator occupies less volume and length than the aerospike, the third or upper propulsion stage 20 may, if desired, be made longer. Without the aerospike bucket in the upper propulsion stage motor 20, the propellant weight may be increased and the ballistic characteristics of the upper propulsion stage improved, both of which would improve the system performance.

Thus, there has been provided, according to the invention, a flexible inflatable shroud 30 that allows the propulsion system including boost, main propulsion stage and upper propulsion stage to occupy substantially all of the available storage space in a submarine storage cylinder or other silo with the shroud, when inflated, providing the desired aerodynamic shape for reducing drag and improving performance. As those skilled in the art will understand, the inflatable shroud, according to the invention, is not limited in its application to submarine launched propulsion systems but may be employed to minimize the weight and stowage space required for aerodynamic shaping for many propulsion applications. The inflatable shroud of the present invention may be used on any aerodynamic structure that would benefit from an improved aerodynamic shape, and is especially applicable to length constrained propulsion systems.

We claim:

1. Apparatus for use on an elongated aerodynamic structure having a stored mode and an operational mode and including a nose cone at a forward portion thereof comprising, a flexible inflatable shroud which in stowed position is folded against the nose cone whereby the aerodynamic structure in the stored mode thereof is allowed to occupy substantially all of the available packaging length, said inflatable shroud in an inflated position extending away from the aerodynamic structure forward of the nose cone to provide a desired aerodynamic shape to reduce drag and improve performance, and means to inflate the inflatable shroud to said inflated position when the aerodynamic structure is deployed into the operational mode thereof.

2. Apparatus as specified in claim 1 wherein said means to deploy the inflatable shroud comprises a gas generator.

3. Apparatus as specified in claim 1 wherein said aerodynamic structure is cylindrical in shape and comprises a multiple stage propulsion system.

4. Apparatus as specified in claim 3 wherein said multiple stage propulsion system is stored in a fixed length and diameter cylinder and is activated into the operational mode thereof from said cylinder.

5. Apparatus as specified in claim 4 wherein said propulsion system is submarine launched.

6. Apparatus as specified in claim 4 wherein the nose cone of the propulsion system is shaped to minimize the extent to which it extends forwardly of the propulsion system, and hence, has undesired aerodynamic characteristics, and wherein said flexible inflatable shroud is folded flush against a forward portion of the nose cone, said inflatable shroud being attached and sealed in an air tight manner to the nose cone at or near the base thereof.

7. Apparatus as specified in claim 6 wherein said means to deploy said inflatable shroud to said inflated position comprises a solid propellant gas generator, said gas generator being mounted on an interior forward wall of the nose cone and having an outlet connection for the gas generated thereby to the sealed space between the nose cone and the inflatable shroud.

8. Apparatus as specified in claim 1 wherein the nose cone of the aerodynamic structure is shaped to minimize the extent to which it extends forwardly of the aerodynamic structure, and hence, has undesired aerodynamic characteristics, wherein said flexible inflatable shroud is folded flush against a forward portion of the nose cone, and wherein said means to deploy said inflatable shroud to said inflated position comprises a gas generator.

9. Apparatus as specified in claim 8 wherein said inflatable shroud is attached and sealed in an air tight manner to the nose cone at or near the base thereof.

10. Apparatus as specified in claim 9 wherein said gas generator is mounted on an interior forward wall of the nose cone and has an outlet connection for the gas generated thereby to the sealed space between the nose cone and the inflatable shroud.

11. Apparatus as specified in claim 10 wherein said inflatable shroud is made of metallic coating deposited on a plastic sheet.

12. Apparatus as specified in claim 10 wherein said inflatable shroud is made of neoprene coated rib stock nylon sheet, the seams of which are sewed and sealed with silicone rubbers.

* * * * *